US006256792B1

(12) United States Patent
MacDonald

(10) Patent No.: US 6,256,792 B1
(45) Date of Patent: Jul. 10, 2001

(54) GLOVE OR MITT PRINCIPALLY FOR USE AS A CATCHING GLOVE BY ICE HOCKEY GOALKEEPERS

(76) Inventor: Donald Francis MacDonald, 29, Pleasant Street, St. Stephen, New Brunswick (CA), E3L 1A3

( * ) Notice: Subject to any disclaimer, the term of this patent is extended or adjusted under 35 U.S.C. 154(b) by 0 days.

(21) Appl. No.: 09/583,733

(22) Filed: May 31, 2000

(30) Foreign Application Priority Data

Jun. 9, 1999 (CA) ..... 2273889

(51) Int. Cl.[7] ..... A41D 19/00
(52) U.S. Cl. ..... 2/161.1; 2/160
(58) Field of Search ..... 2/159, 161, 1, 2/160, 18, 19

(56) References Cited

U.S. PATENT DOCUMENTS

| | | | | |
|---|---|---|---|---|
| 2,493,977 | * | 1/1950 | Kochman | 2/19 |
| 2,842,771 | * | 7/1958 | Foti | 2/19 |
| 3,438,630 | * | 4/1969 | Petti | 2/159 |
| 4,700,404 | * | 10/1987 | Lesperance | 2/16 |
| 4,768,681 | * | 9/1988 | Dean et al. | 2/79 |
| 4,967,418 | | 11/1990 | Marcotte | 2/16 |
| 5,152,532 | * | 10/1992 | Rouse | 2/19 |
| 5,435,008 | | 7/1995 | Shane | 2/16 |
| 5,781,929 | * | 7/1998 | Shikatani | 2/16 |

* cited by examiner

*Primary Examiner*—Bibhu Mohanty
(74) *Attorney, Agent, or Firm*—Jones, Tullar & Cooper, P.C.

(57) ABSTRACT

A glove principally for use as a catching glove by a hockey goalkeeper has the usual finger pocket with an outer side for overlying the goalkeeper's knuckles, and further comprises a hockey stick retainer which overlies a portion of the outer side of the finger pocket and is connected to a control mechanism for controlling movement away from this outer side portion. The retainer has a stiffness such that, with the control mechanism acting on the retainer, a hockey stick can be held firmly between the outer side portion and the retainer while all the goalkeeper's fingers remain in the finger pocket means. The glove can hold a hockey stick or like article without requiring any use of the thumb, and can also be used in other sports, and in other situations, where a player or a user does not have an operative thumb.

19 Claims, 17 Drawing Sheets

GLOVE OR MITT PRINCIPALLY FOR USE AS A CATCHING GLOVE BY ICE HOCKEY GOALKEEPERS

BACKGROUND OF THE INVENTION

1. Field of the Invention

The present invention relates to a glove or mitt principally for use as a catching glove by goalkeepers in games such as ice hockey. For convenience, the term "glove" will be used herein, as it is common parlance, even though such gloves may only have one pocket for the player's four fingers.

The glove of this invention allows a sports implement such as a hockey stick, or the handle of other sports implements, such as a tennis racquet, or of a tool, to be held without the player using his thumb, and accordingly it may also be useful for players of various games, and for workers, needing to hold such handles when a thumb is missing or disabled.

2. Prior Art

In the game of ice hockey, goalkeeper's hands require considerable protection since it is necessary for these to catch or deflect hard pucks which travel very fast. For the catching hand, which may be the right or left hand, gloves have been used which are basically similar to those used in baseball, having a padded finger pocket or pockets and a padded thumb pocket connected by webbing which spans the gap between these pockets, and which is used to catch a puck. However, unlike with baseball gloves, hockey goalkeeper's catching gloves also have to allow the goalkeeper to hold and manipulate a hockey stick, and in the known construction the gloves often have too much padding and are too stiff to allow good stick handling, especially if the goalkeeper does not have strong hands.

There have been a number of past attempts to improve on the ability of a hockey goalkeeper's catching glove properly to grasp his hockey stick. These efforts all have one or more critical drawbacks, such as compromising the glove or goalkeeper's catching ability, adding too much weight, being too complicated with too many moving parts increasing the likelihood of breakdown, or failing to provide a quick and sure grasp and release of the stick.

Specific prior art designs are described in the following U.S. patents:

U.S. Pat. No. 4,967,418 to Marcotte, issued Nov. 6, 1990; and

U.S. Pat. No. 5,435,008 to Shane, issued Jul. 25, 1995.

Marcotte describes a glove having thumb and finger pockets of generally conventional type, but having, on the outer or back side of the finger pocket, an additional part for gripping the stick. This is a so-called "gripping pocket", which is a flexible pocket into which the fingers can be inserted. An opening is provided connecting the usual finger pocket to the gripping pocket, so that when the goalkeeper wishes to grip the stick he can move his fingers from the finger pocket to the gripping pocket and then use the fingers to hold the stick between the inside of the gripping pocket and an outer side portion of the collapsed finger pocket which is held against the stick by the thumb. The drawback of this is that the goalkeeper may need to move his fingers quickly from the gripping pocket to the finger pocket in order to make a save, and this may be awkward with this construction.

In Shane, the stick is held in the normal way, between the finger pocket and the thumb pocket, but means are provided to improve the grip on the stick. The means shown by Shane are believed to add undesirable weight and restrict the catching ability.

In both these prior patents, the thumb is needed to apply holding forces to one side of the hockey stick, and accordingly these constructions do not offer any solution to a player of ice hockey, or of any other game, where the player has a missing or disabled thumb.

SUMMARY OF THE INVENTION

The present invention, like that of Marcotte, provides an additional part at the outside of the finger pocket or pockets (hereinafter the "finger pocket means") which can be used to hold a stick against the outside of that pocket means. However, with the present invention, the player's fingers stay in the usual finger pocket portion of the glove, whether he is making a save or handling the stick. The glove of this invention allows the user to quickly and surely grip and release the shaft of a hockey stick without compromising the glove's ability to catch a puck, and without adding much weight. It also allows the goalkeeper to shoot forehand, backhand, and to "stickhandle", and even execute the "slapshot", all with the same proficiency as a forward position player.

In accordance with the one aspect of the present invention, a glove for use by a hockey goalkeeper, of the type having finger pocket means and a thumb pocket and in which the finger pocket means forms part of the glove body having an outer side or back positioned to overlie the goalkeeper's knuckles and having an inner or palm side, further comprises a hockey stick retainer which overlies a portion of the said outer side, the stick retainer being connected to control means for controlling movement of the retainer away from the outer side portion and having a stiffness such that, with the control means acting on the retainer, a hockey stick can be held firmly between the outer side portion and the retainer while all the goalkeeper's fingers remain in the finger pocket means.

The glove of this invention effectively holds the stick against the back of the catching hand, and does not require use of the thumb for holding the stick. This feature makes the glove suitable for players of other sports in which an implement handle may need to be held without the use of a thumb, and also for users of other implements or tools who lack a usable thumb. More generally, therefore, in accordance with this broader aspect of the invention, a glove for holding the handle portion of a sports implement such as a tennis or badminton racquet, or of a hockey stick or lacrosse stick, or of a tool, and having finger pocket means with an outer side overlying the user's fingers, also has a handle retainer which overlies a portion of the outer side of the finger pocket means, and is connected to control means as described above.

The control means may include spring means acting to pull the retainer towards the outer side portion. The spring means may be constituted by the resilience of the retainer, which may be in the form of a resilient gripping plate.

Preferably, the control means include a stop member which limits the movement of the retainer relative to a stiff plate located at the inner or palm side of the finger pocket means, and the finger pocket back or outer side is flexible to allow the player's fingers to be bent so that the fingertips press against the stiff plate while outwards movement of the finger knuckles causes the outer side portion of the finger pocket means to firmly grasp the stick or handle between itself and the retainer. The stiff plate "located at" the inner or palm side of the finger pocket means may be inside or outside the finger pocket means. The control means may include a hollow chamber attached to the stiff plate, and a stop member having an inner end mounted for limited movement in the chamber and having an outer end restricting movement of the retainer away from the stiff plate.

Preferably, the control means are located in an outer finger area between the second knuckles and finger tips of fingers placed within the finger pocket means, and the retainer has an additional connection to an outer end portion of the glove outwardly beyond the finger tip position. The stiff plate may be part of a palm plate forming the inner side or front of the body of the glove and of the finger pocket means. The retainer may have two spaced connections to the body of the glove both located near the outer edges of the palm plate and outwardly beyond the finger tip position. The control means may be associated with a divider between two finger pockets each of which accommodates two of a player's fingers.

Unlike with Marcotte, the finger pocket means has no aperture allowing the fingers to be moved out of the normal catching position. Also, while in Marcotte the stick is inserted under the fingertip end of the "gripping pocket", in the present invention the entry of the stick into the retainer is from the knuckle or wrist end of the hand.

The outer side portion of the finger pocket means may include a rigid member, which acts as a stabilizer, a part of which is a pressure member which projects through the outer side of the finger pocket means, and a part of which is a plate inside the finger pocket means and contactable by the knuckle areas of a user's fingers, these parts being arranged so that the pressure member can be caused to press against an inner side of the handle by flexing of the fingers.

BRIEF DESCRIPTION OF THE DRAWINGS

Preferred embodiments of the invention will now be described by way of example with reference to the accompanying drawings, in which.

DETAILED DESCRIPTION

Figure 1:
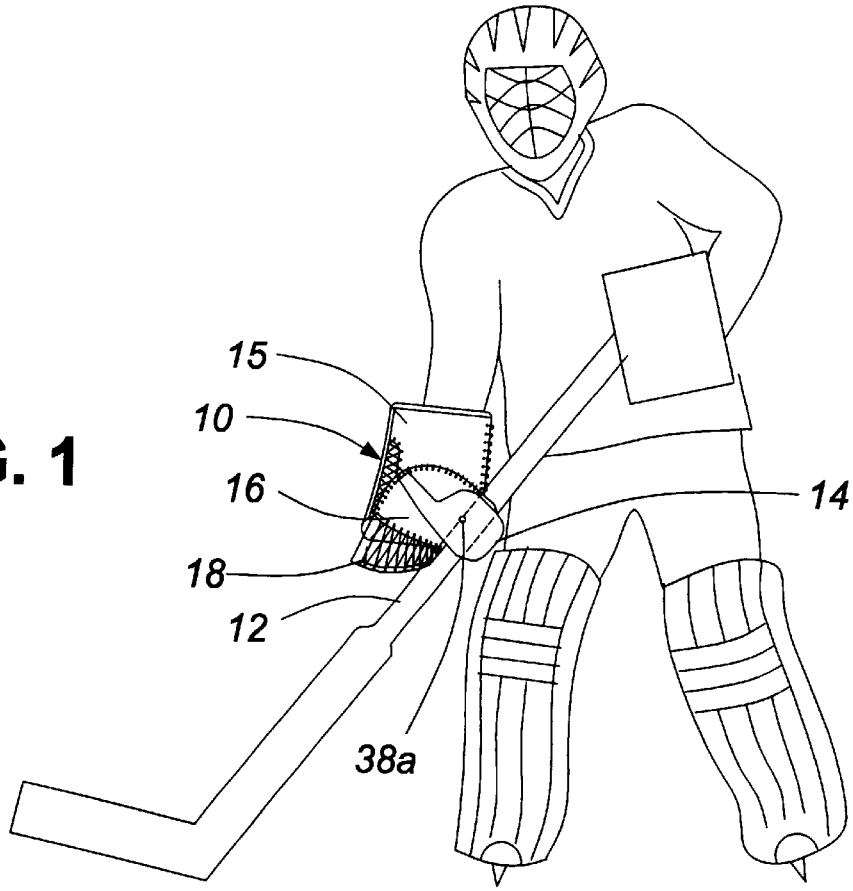
FIG. 1 illustrates a hockey goalkeeper assuming a shooting posture while grasping the shaft of his stick by a right hand glove incorporating this invention.

FIG. 1 shows a goalkeeper using a catching glove indicated at 10 on his right hand to hold the shaft or handle 12 of a hockey stick, the stick being held onto the back or outside of the finger portion of the glove by a retainer or gripping plate 14.

Figure 2:
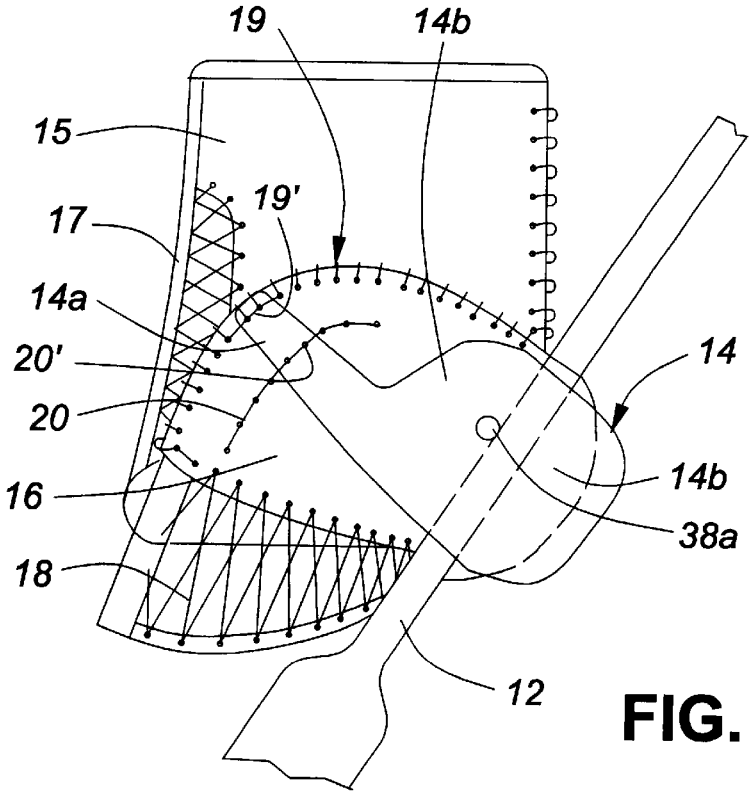
FIG. 2 is an enlarged view of the glove showing the relationship to the stick.
Figure 3:
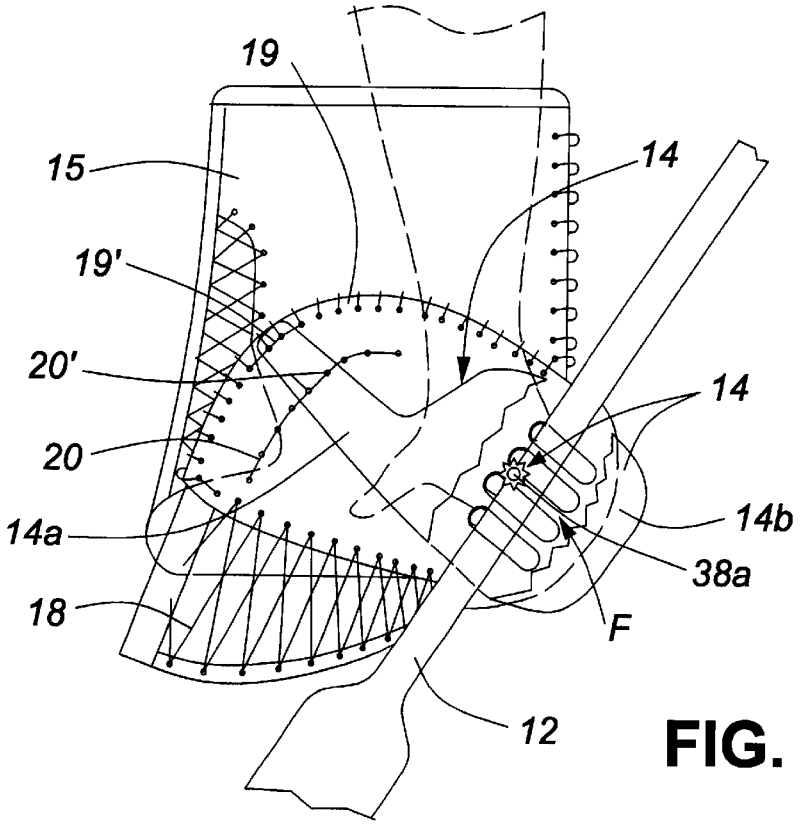
FIG. 3 is a view similar to FIG. 2 but in which the stick retainer or "gripping plate" has been partly cut away.
Figure 5:
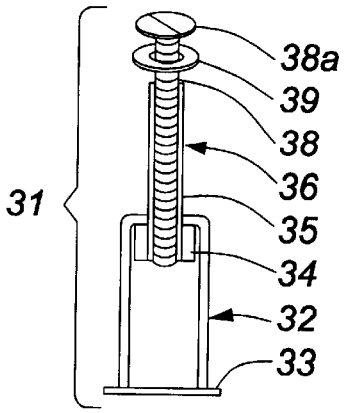
FIG. 5 is an enlarged, partly sectional view of the side of control means of the gripping plate which limit outward movement of the gripping plate away from the finger pocket, the control means being shown extended.
Figure 6:
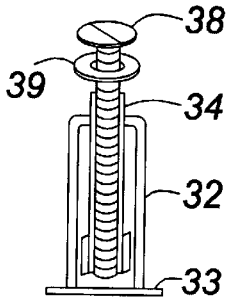
FIG. 6 is a further view of the control means in a retracted position, viewed parallel to the finger direction.
Figure 7:
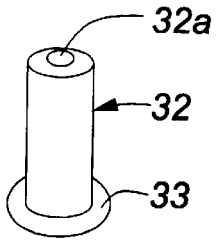
FIG. 7 is a perspective view of a hollow chamber part of the control means.

As shown in more detail in FIGS. 2 and 3, a main part of the glove is conventional in having a cuff 15, and is similar to a baseball mitt in having a finger pocket means 16 and a thumb pocket 17. These finger and thumb pockets are connected by webbing 18 which allows the user to catch a puck. The finger pocket means 16 has two pockets each accommodating two of the player's fingers, the finger pockets forming a part of the glove body 16'. This glove body has lacing 19 at an outer rim and additional lacing 20 along an inner seam roughly parallel to and spaced within the outer rim.

Figure 4:
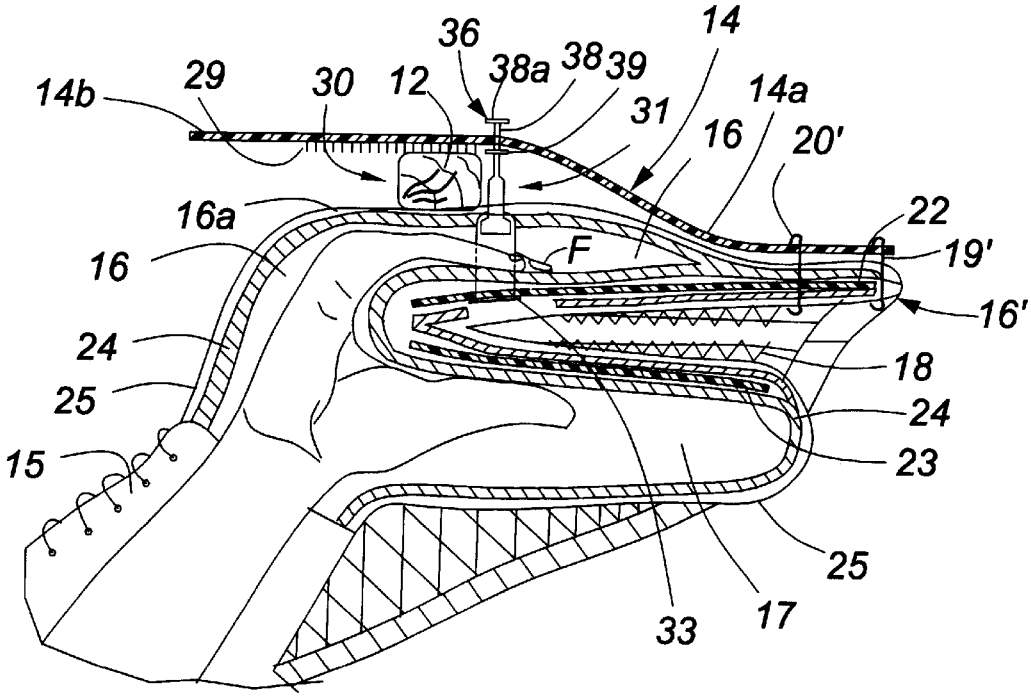
FIG. 4 is a generally horizontal section of the glove of this invention, used on a player's right hand, and looking down the axis of the stick.

As shown in FIG. 4, the inner side or front of the finger pocket means 16 and glove body 16', facing the thumb pocket 17, is covered with a protective palm plate 22. This extends out beyond the ends of a player's fingers F by an amount slightly greater than a finger length, to the outer edge of the glove body. The inner side of the thumb pocket has a thumb plate 23 facing the palm plate 22; these plates provide additional protection when the player is catching a puck. All these areas of the glove are covered by padding 24, which itself is covered by a leather outer covering 25.

FIGS. 2 to 9 show details of the hockey stick retainer, and control means for the retainer, in accordance with the invention.

The stick retainer is in the form of a "gripping plate" 14 of shatter proof plastic having a shape shown in FIGS. 2 to 4 and 9. The plate has a narrow end portion 14*a* which is tightly secured to the outer side of the glove body 16' by parts 19' and 20' of the lines of stitching or lacing 19 and 20, at fixed locations respectively near the curved outer rim of the palm plate and spaced within this rim, so that the secured end of the gripping plate is substantially rigid with the palm plate.

As seen in edgewise view, for example in FIG. 4, when the gripping plate 14 is deployed to hold the stick handle 12, the narrow portion 14*a* on the knuckle side of the fixed locations 19' and 20' is bowed outwardly from the glove body to leave a clearance space at the outer side of the finger pocket means 16. As seen in front view, FIG. 2, plate 14 also broadens laterally into portion 14*b*, and this portion retains the stick 12 at about its longitudinal center. On the fingertip side of this center is an aperture which receives the outer end of a stop member 36 which is part of control means 31 shown best in FIGS. 4 to 8 and described below. As seen in FIG. 4, just to the finger tip side of the stop member 36 the gripping plate portion 14*b* is slightly bent inwardly so that, when the plate is separated by stick 12 from the outer side portion 16*a* of the finger pocket means it is roughly parallel to this outer side portion. The inner surface of the gripping plate portion 14*b*, as shown in FIG. 9, has a high friction, rubberized area shown at 29 which is opposite the outer side portion 16*a* of the finger pocket means. The outer side portion 16*a* and area 29 between them constitute a gripping zone 30. This glove outer side portion may have a rubberized area for better holding of the stick.

Figure 10:
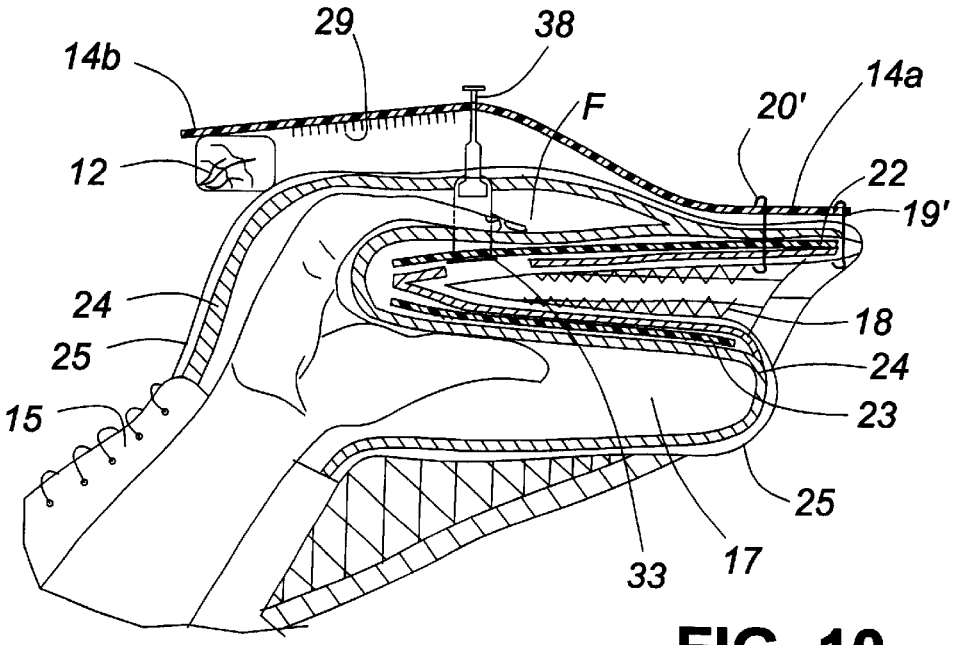
FIGS. 10 to 12 are views similar to FIG. 4, showing successive positions of the hockey stick as it is inserted into the retainer or gripping plate of the glove.

The gripping plate 14 is resilient, and when unstressed lies close to the outer surface of the glove body 16', as indicated in FIG. 10.

Figure 8:
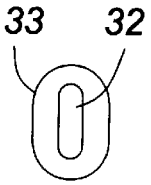
FIG. 8 is a bottom end view of the same part.
Figure 9:
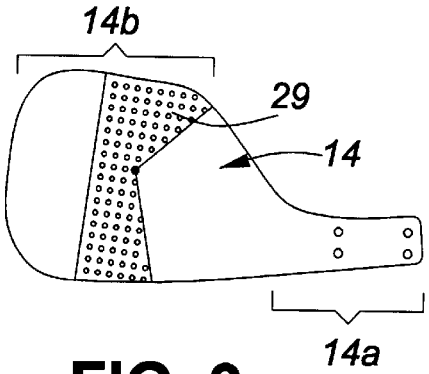
FIG. 9 is an inside view of the gripping plate.

Referring to FIGS. 4 to 8 showing the control means 31, these include a hollow base part 32 which passes through an aperture in the palm plate 22 and terminates in a flange 33 attached to the outside of this palm plate. This base part 32 is oval in cross-section, as shown in FIG. 8, being elongated in the direction of a user's fingers so as to be accommodated within a divider which separates the two pockets of the finger pocket means 16, and which fits between the middle and ring fingers of the player, usually at a location between the second and third knuckles of the fingers. Base part 32 has an elongated chamber in which is slidable the enlarged inner end 34 portion of a bushing 35 forming part of the movable stop member 36. Bushing 35 has a narrow outer portion which can slide through an outer end aperture 32*a* in the housing until the inner end portion 34 meets the inside top of the chamber. The bushing 35 houses a threaded portion of an adjustable screw 38 which passes through the gripping plate portion 14*b* and terminates in a head 38*a* on the outside of the gripping plate, this plate being held between the head 38*a* and a nut 39 inside the plate. The parts 35, 38 and 38*a* form parts of the movable stop member 36. Instead of the nut 39, a snap washer may be used.

As will be apparent from FIG. 4, the arrangement is such that when the user's fingers are bent, with his finger tips pushing against the rigid palm plate 22 (through the intermediary of the inside of the finger pocket means), the outwards movement of the knuckles pushes out the outer side portion 16*a* of the finger pocket 16, and traps the hockey stick 12 between this outer side portion and the high friction surface 29 of the gripping plate, the outwards movement of which is limited by the head 38*a* of the stop member 36. The screw 38 can be adjusted in the bushing 35 to suit different player's hands.

Figure 11:
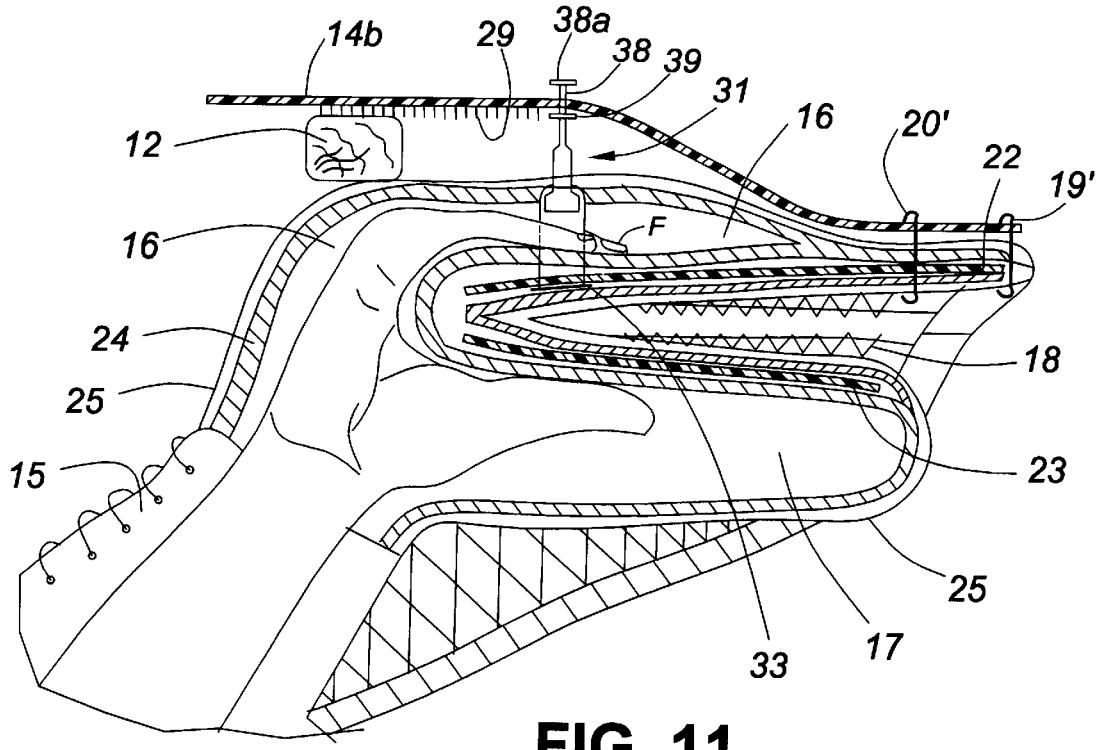
Figure 12:
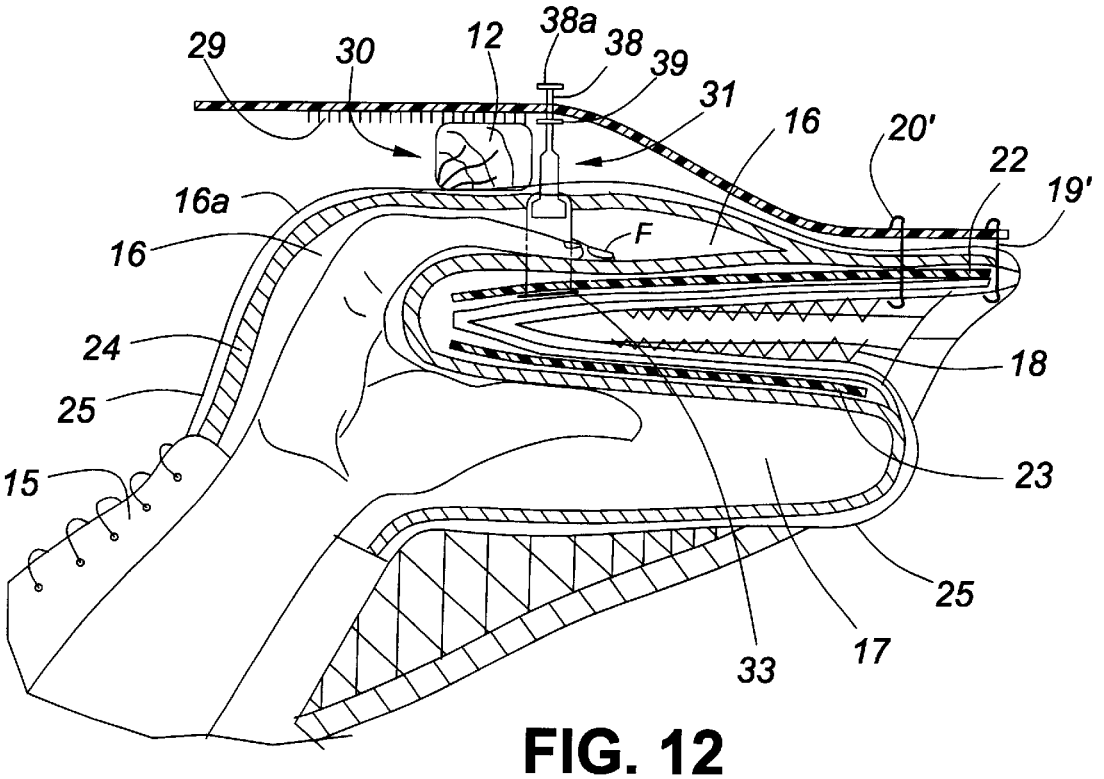

FIGS. 10 to 12 show stages in the insertion of the stick into the gripping zone 30 under the gripping plate 14. In FIG. 10, the gripping plate is resting against the outer surface of the finger pocket 16 means, with the stick 12 being inserted under the free edge of the gripping plate which provides an insertion area. Immediately upon contact with the stick 12 the plate 14 rises to accept the stick. FIG. 11 shows the next stage, where the stick is being slid between the pocket outer surface and the gripping plate, into the gripping zone 30. FIG. 12 shows the final position, in which the fingers are slightly bent so that the knuckles push out the outer surface portion 16*a* while the high friction surface 29 of the gripping plate is pulled against the stick, holding it firmly.

The stick is easily released in the follow through of any shooting or stick handling manoeuvre by a slight inward or outward rotation of the wrist.

While the control means as described is practical, the invention is not limited to this specific control means. For example, the control means may comprise a simple or composite spring connection between the gripping plate and the palm plate, or a resilient gripping plate having suitable connections to a rigid palm plate, may also be used.

In addition, instead of a single control means 31 positioned between the fingers, a pair of control means may be used, each including one of a pair of hollow chambers situated on outer sides of the user's four fingers.

As mentioned above, the basic parts of the invention can be used in many other circumstances where it is required for a hand with a disabled thumb, to hold the handle of a sports implement or a tool. Clearly, in many such cases, the glove will not need any thumb pocket, and the term "glove" should be understood as referring to merely the essential parts of the invention, namely the finger pocket means, handle retainer, and control means acting on the retainer.

FIGS. 13, 13A, 14 and 14A show alternative means of connecting control means to a gripping plate and palm plate, which allows for adjustment of the connection point.

Figure 13:
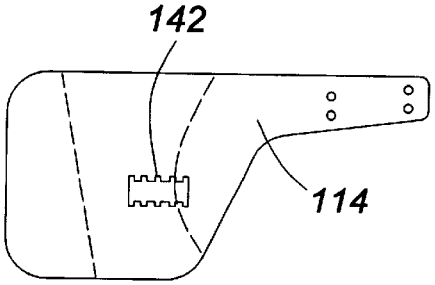
FIG. 13 shows an alternative embodiment of gripping plate.
Figure 13A:
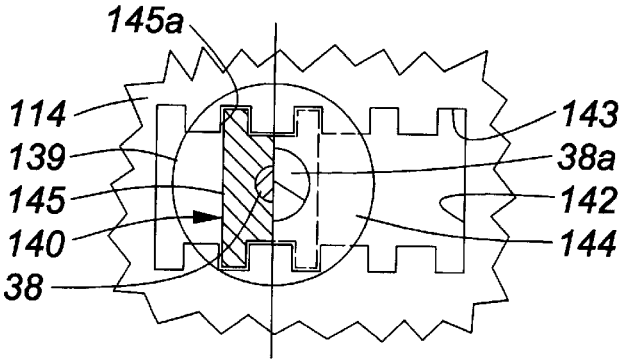
FIGS. 13A and 14A are fragmentary, partly sectioned views of portions of the gripping plate and parts of the control means connected thereto.

As shown in FIGS. 13 and 13A, a gripping plate 114 has a slot 142 with generally parallel sides, the sides having a series of opposed notches 143. This slot receives an adapter member 140 which includes a large outer washer portion 144 held by the screw head 38*a*. The adapter member 140 is held between a large diameter nut 139 and the screw head 38*a*, the nut 139 and washer portion 144 being large enough to overlap portions of the gripping plate 114 at the sides of the slot 142. The member 140 has an inner portion 145 with each of its opposite sides formed with a pair of spaced protrusions 145*a* which fit into selected notches 143. The portion 145 is short relative to the slot 142 and can be fitted into the slot at different positions along the slot, as required to adjust the parts, for comfort of grip, to different lengths of fingers, being secured by pressure between inner nut 139 and outer washer portion 144 on the inner and outer sides of the gripping plate.

Figure 14:
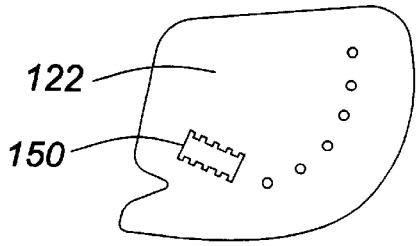
FIG. 14 shows an alternative palm plate for attachment to the inner surface of a glove body.
Figure 14A:
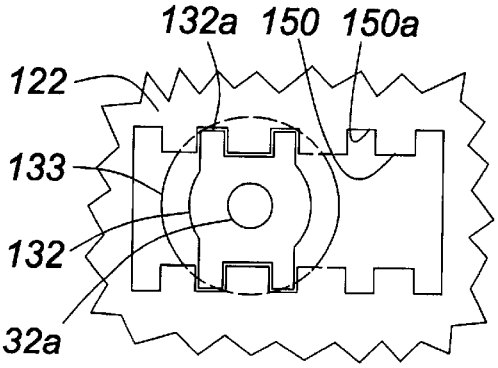

FIGS. 14 and 14A show a similar adjustability for the connection between the palm plate 122 and the hollow base part 132 corresponding to part 32 previously described, and which allows the position of the control means to be moved forwardly and rearwardly relative to the user's hand. As shown, the palm plate has a slot 150 similar to slot 142, and the base part 132 is formed with protrusions 132*a* which can be fitted into notches 150*a* at the sides of the slot at several different positions of the base part along the slot. The flange 133 at the bottom of the base part is large enough to overlap the sides of the slot 150, and holds the base part in place.

Figure 15:
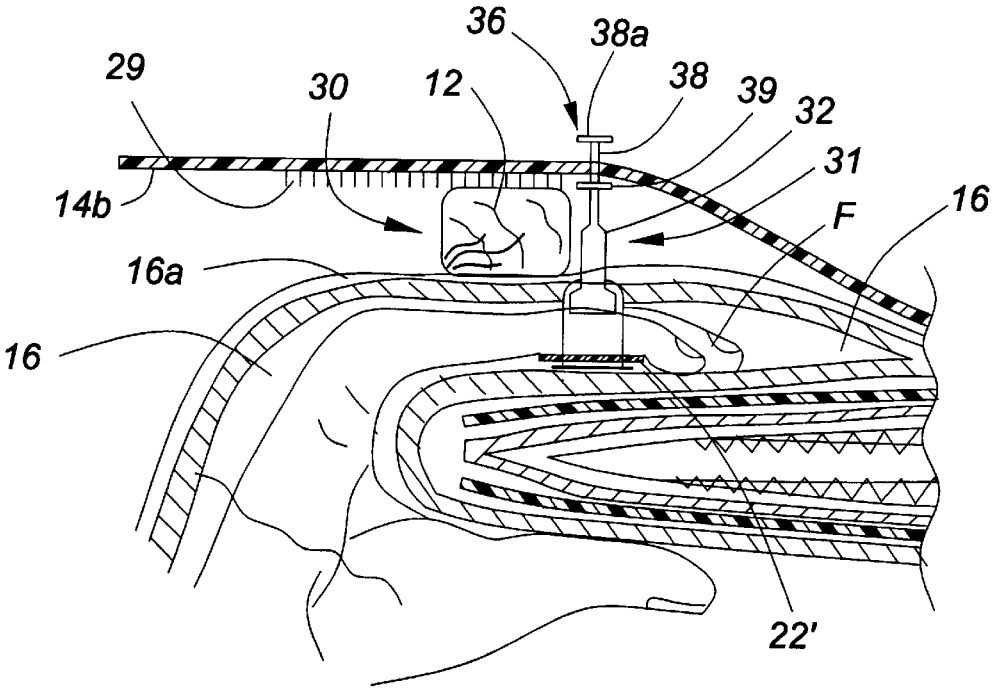
FIG. 15 is a fragmentary view of part of what is shown in FIG. 4, but with an alternative arrangement of control means.

FIG. 15 shows a construction which is similar to that of FIG. 4, but in which the flange 33 of the base part 32, instead of being mounted on the palm plate 22, is connected to a stiff plate 22' which is inside the finger pocket means, and not attached to the finger pocket means. This plate has its outer edge under the fingertip portions of the user's fingers F, and sufficiently far forward to be pressed down when the fingers are bent as shown, so as to pull the stop member 36 inwardly. It will be understood that the term "fingertips" includes these end portions of the fingers.

As mentioned earlier, a pair of control means may be used, one control means being situated on each of opposite sides of the user's fingers, and this is one feature of the embodiment of FIGS. 16 to 25, where the control means are shown as 231. Another feature of this embodiment is the use of a rigid member 200, termed a stabilizer, having a part which may constitute an outer side portion of the finger pocket means which contacts and grips the handle 12.

Figure 17:
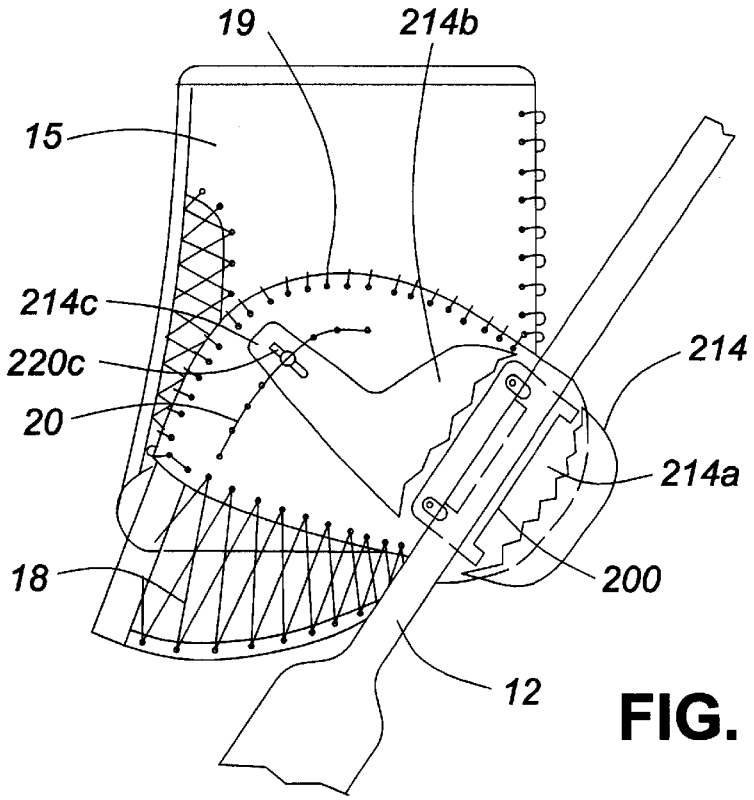
FIGS. 17 and 18 are partially cut-away views of the FIG. 16 embodiment.
Figure 18:
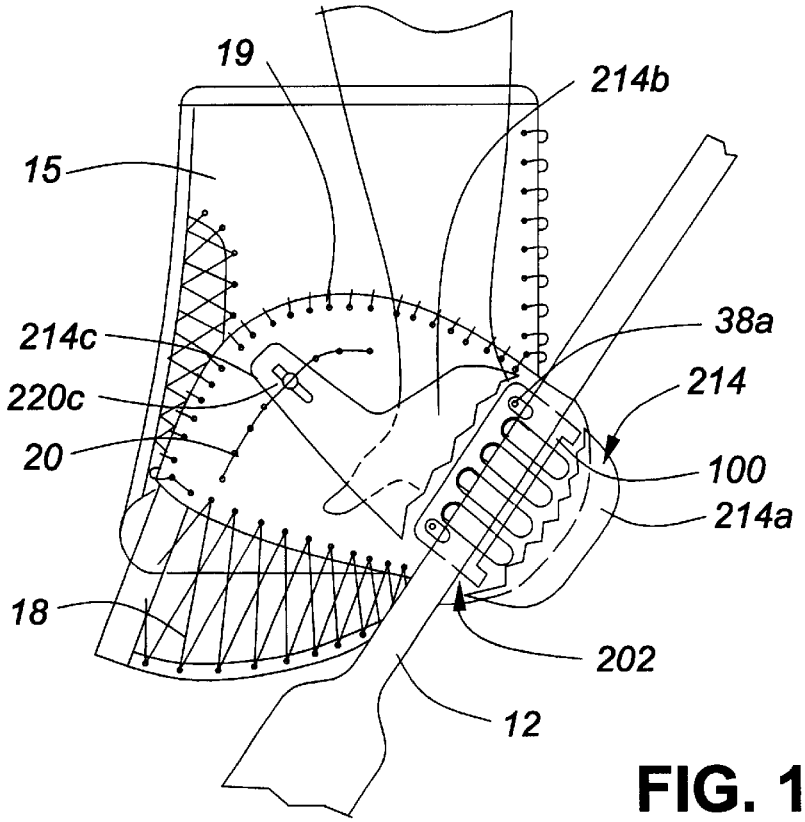
Figure 19:
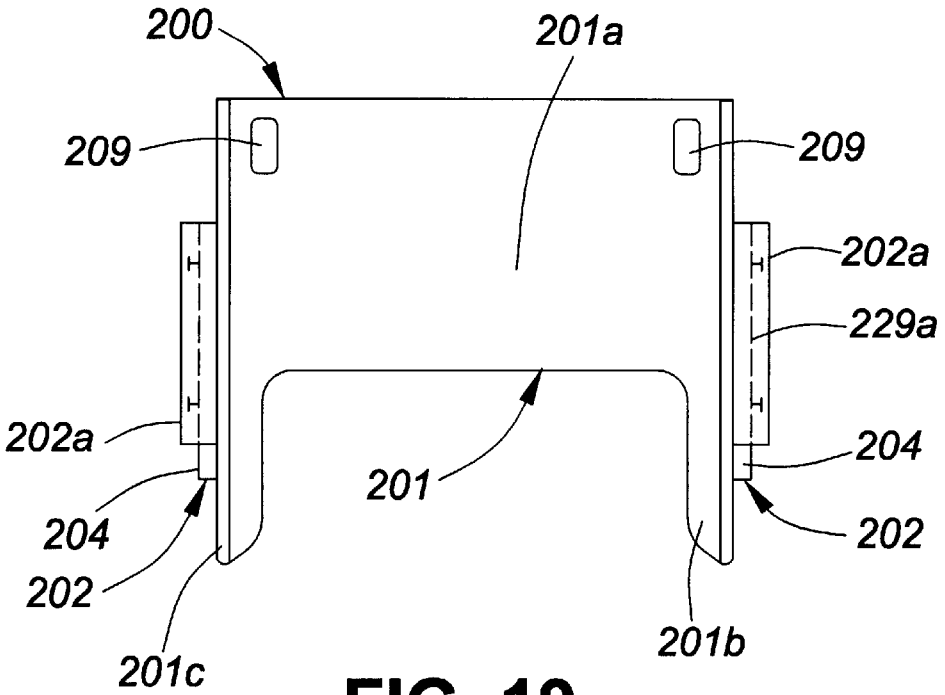
FIG. 19 is a top plan view of the rigid stabilizer member.
Figure 20:
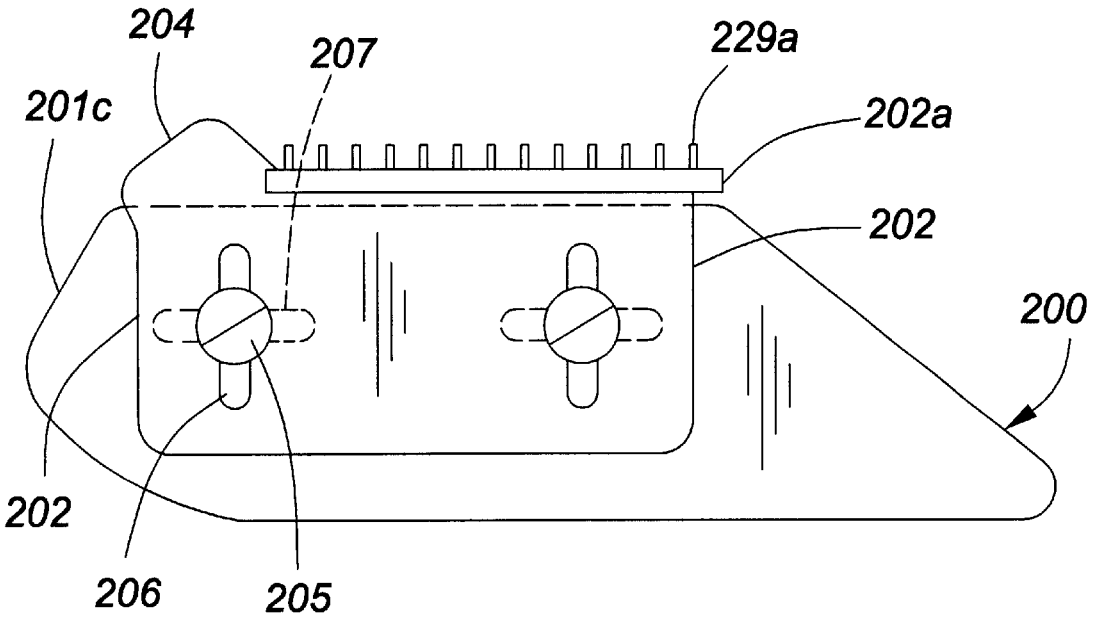
FIG. 20 is a side view of the stabilizer member.
Figure 21:
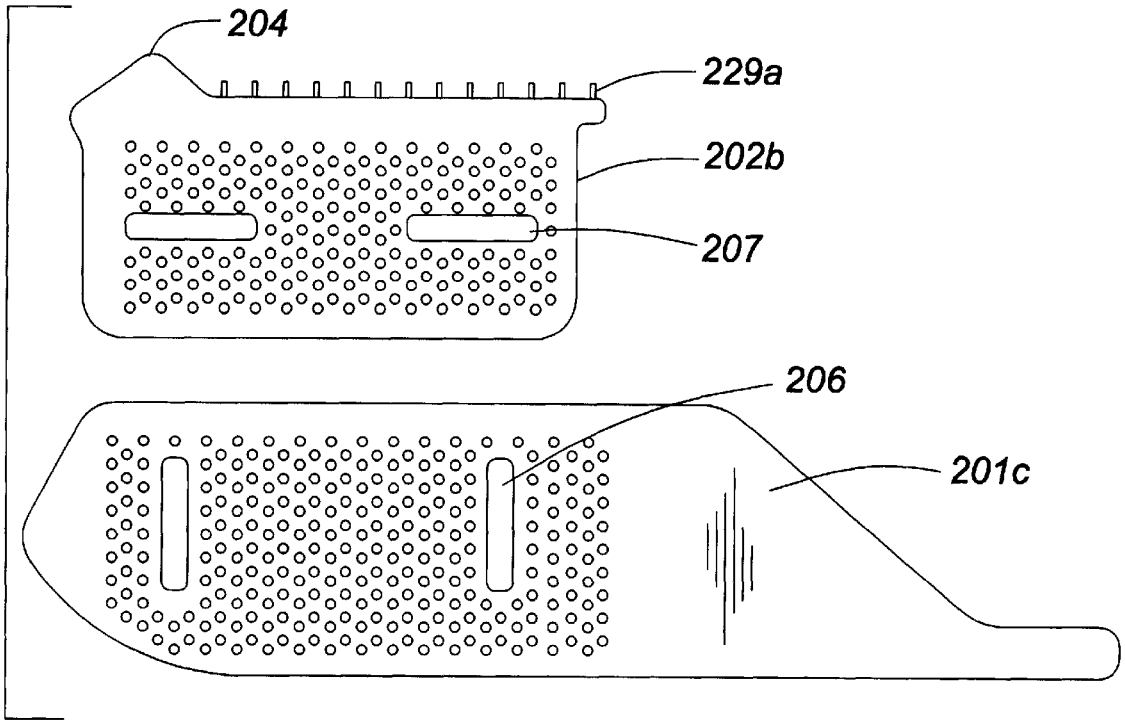
FIGS. 21 and 22 are disassembled views of the stabilizer member.

As shown in FIGS. 16 to 23, the rigid member or stabilizer 200 has two parallel side plates 202 connected to the flanges 201*c* of a stiff bar or bridging member 201, described below, which is positioned to fit under the central or knuckle area of a user's fingers F, inwardly (i.e. rearwardly) of the control means 231. The stabiliser 200 is held in place by having two apertures 209 at outer, forward areas of the bridging plate 201, as shown in FIG. 19, each aperture being fitted onto one of the two spaced control means 231. The side plates 202 each have an outer edge which projects through an associated slit in the covering material 24, 25 of the outer side of the finger pocket means, and these outer edges form pressure members which contact the handle, and which may also be each provided with a gripping surface 229*a*.

The form and positioning of the stabilizer 200 is such that the bridging plate 201 lies under the knuckle area of the fingers F, sufficiently to the rear of the fingertips which hold the control means 231 so that bending of the fingers causes the gripping surfaces 229*a* to increase their pressure on the handle 12, and these surfaces assist the outer side portion of the glove which overlies the knuckles to hold the handle against the gripping plate 214 and to stabilize the handle when shooting a puck.

Figure 22:
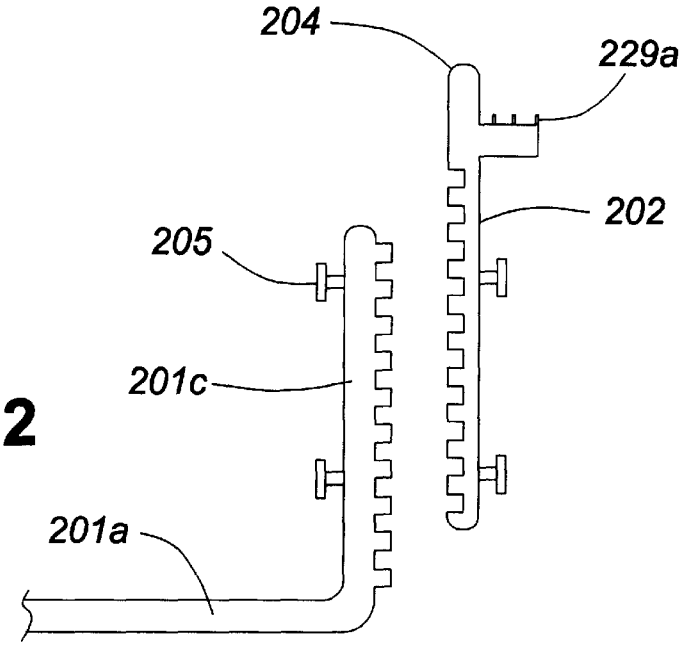
Figure 23:
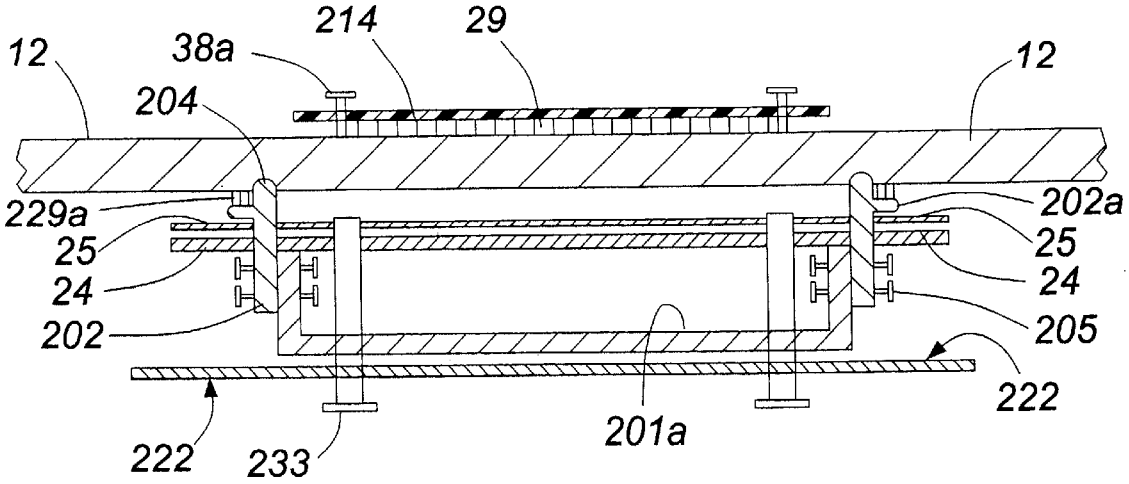
FIG. 23 is a sectional view through the finger pocket means of the glove showing the stabilizer.

FIGS. 19 to 23 show details of the stabilizer 200. FIG. 19 shows the form of the bridging part 201 having a main section 201*a* for underlying the knuckle areas of fingers and rearwardly extending side wings 201*b*, the outer sides of sections 201*a* and 201*b* being bent upwardly to form flanges 201*c*. These flanges hold the adjustable side plates 202 by means of screws 205 which engage in vertically elongated slots 206 in the side flanges and horizontally elongated slots 207 in the side plates, or vice versa, these slots allowing adjustment of the side plates both upwardly and forwardly/rearwardly relative to the part 201. As shown in FIG. 22, the facing surfaces of the side plates 202 and the flanges 201*c* have interengaging depressions and raised areas to lock the side plates in position relative to the flanges. The gripping surfaces 229*a* are located on ledges 202*a* at the outer edges of the side plates.

Figure 16:
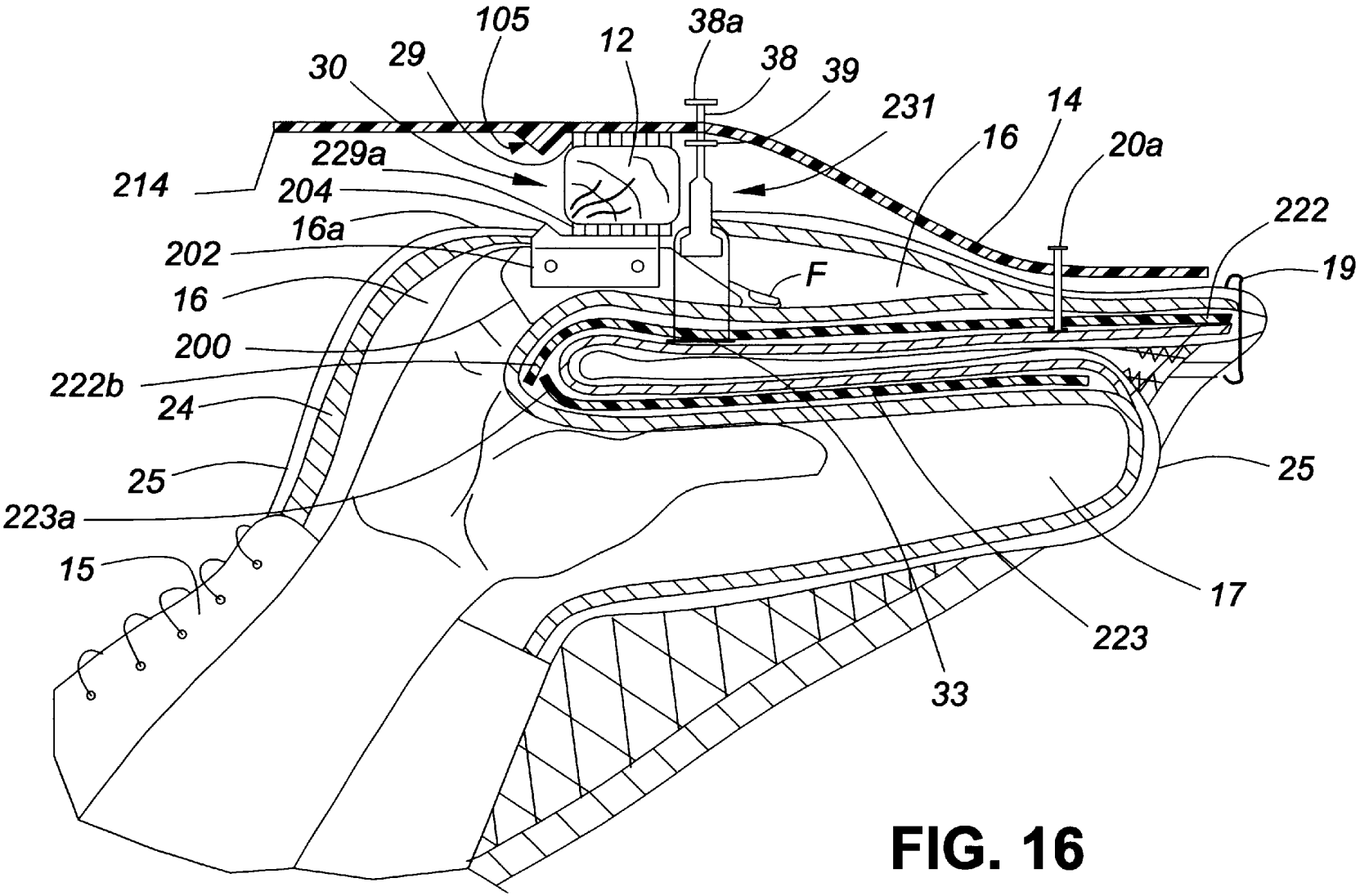
FIG. 16 is a view similar to FIG. 10 of a modified glove having a rigid or stabilizer member.

The rear ends of the outer edges of the side plates 202 are each provided with a raised portion 204, and these partly define the entrance to the gripping zone 30, the portions being sloped to allow for easy entrance and exit of the stick handle 12 into the gripping zone while helping to secure the handle in the gripping zone. These cooperate with a raised area 105 on the interior of the gripping plate 214 and having inner and outer sloped ends, as seen in FIG. 16, and which also serves to define the entrance to the gripping zone 30. The resiliency of the connection between the control means 231 and the palm plate 222 allows the handle 12 to be snapped into the gripping zone 30.

The glove may have either the raised area 204 of the stabilizer or the raised area 105 of the gripping plate, or both. The stabilizer may rest on the inner surface of the padding 24 or may be in direct contact with the palm plate, or may be arranged otherwise as described below. These stabilizer arrangements are all desirable in providing control for shooting the puck.

Figure 24:
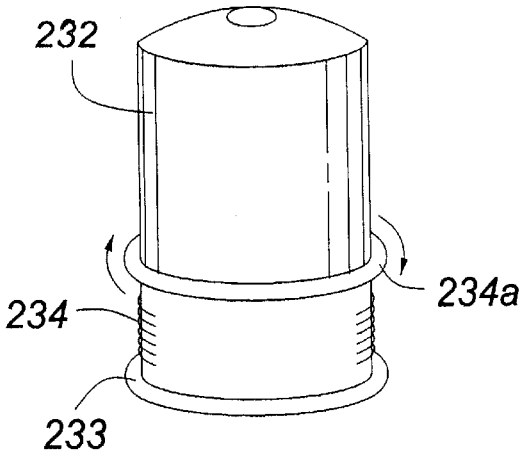
FIG. 24 is a perspective view of the hollow base part of the control means of FIG. 16.
Figure 25:
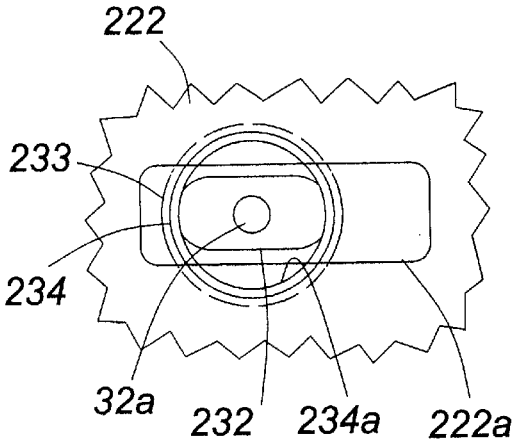
FIG. 25 is a fragmentary view of a portion of the palm plate holding the hollow base part of the control means of FIG. 24.

FIGS. 24 and 25 show part of the control means 231 used in this embodiment, namely a base part 232 which is elongated fore-and-aft and has threaded areas 234 on each end, these being the ends which are outermost, towards the finger tips, and innermost towards the palm. These threaded areas accept threaded washer 234*a* which secures hollow base part 232 to the palm plate 222 through aperture 222*a*, as shown in FIG. 25, and could also secure the stabilizer to the palm plate as shown in FIG. 26.

As shown in FIG. 16, the innermost edge 222*b* of the palm plate 222, nearest the user's palm, may be curved outwardly away from the palm, and the innermost edge 223*a* of the thumb plate 223, nearest the user's palm, may also curve outwardly corresponding with and lying in front of the curved edge of the palm plate 222. When the glove is closed and the stick 12 is in the gripping zone 30, the curved edge 222*b* of the palm plate 222 and the edge 223*a* of the thumb plate 223 are in contact, while at the same time the outer edges of these plates, beyond the finger tips, are also pressed close together, lending additional stability to the grip and enhancing the shooting ability of the glove.

FIGS. 16, 17 and 18 also show means for adjustment of the stabilizer and gripping plate 214 lengthwise of the fingers. The gripping plate 214 has an elongated slot 220*c* shown in FIGS. 17 and 18, and this can receive a screw part 20*a* shown in FIGS. 16 and 17 at different positions.

Figure 27:
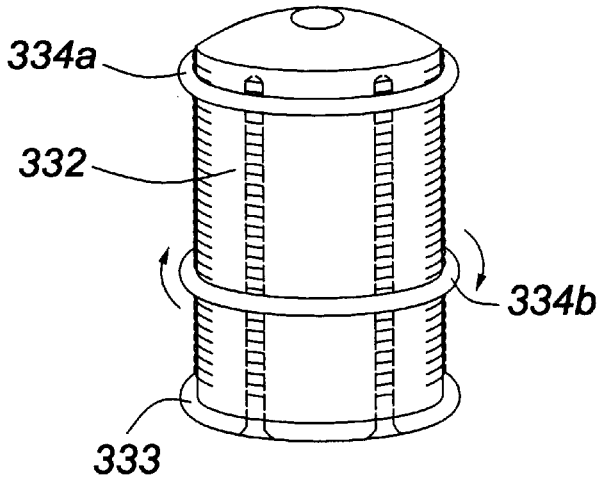
FIG. 27 is a perspective view of a modified form of the hollow base part of the control means.
Figure 28:
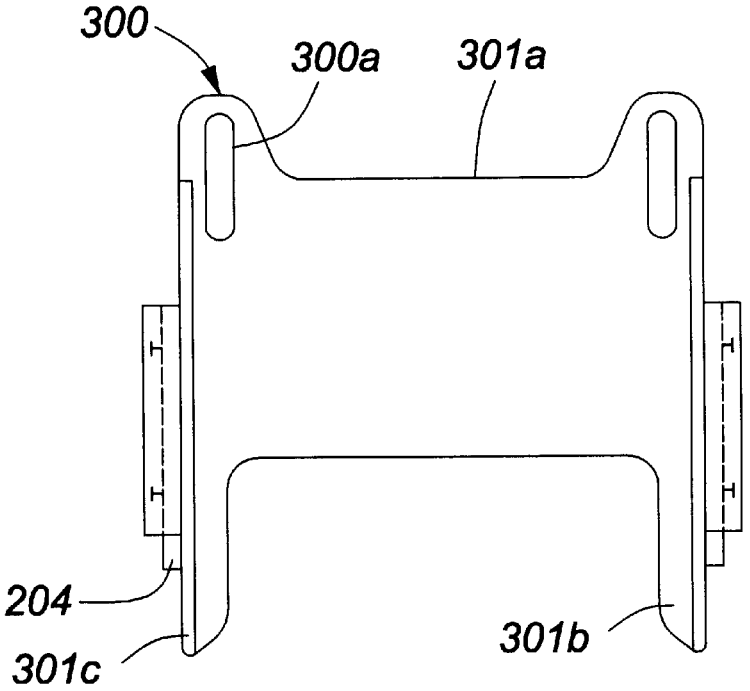
FIG. 28 is a plan view of a modified stabilizer.
Figure 26:
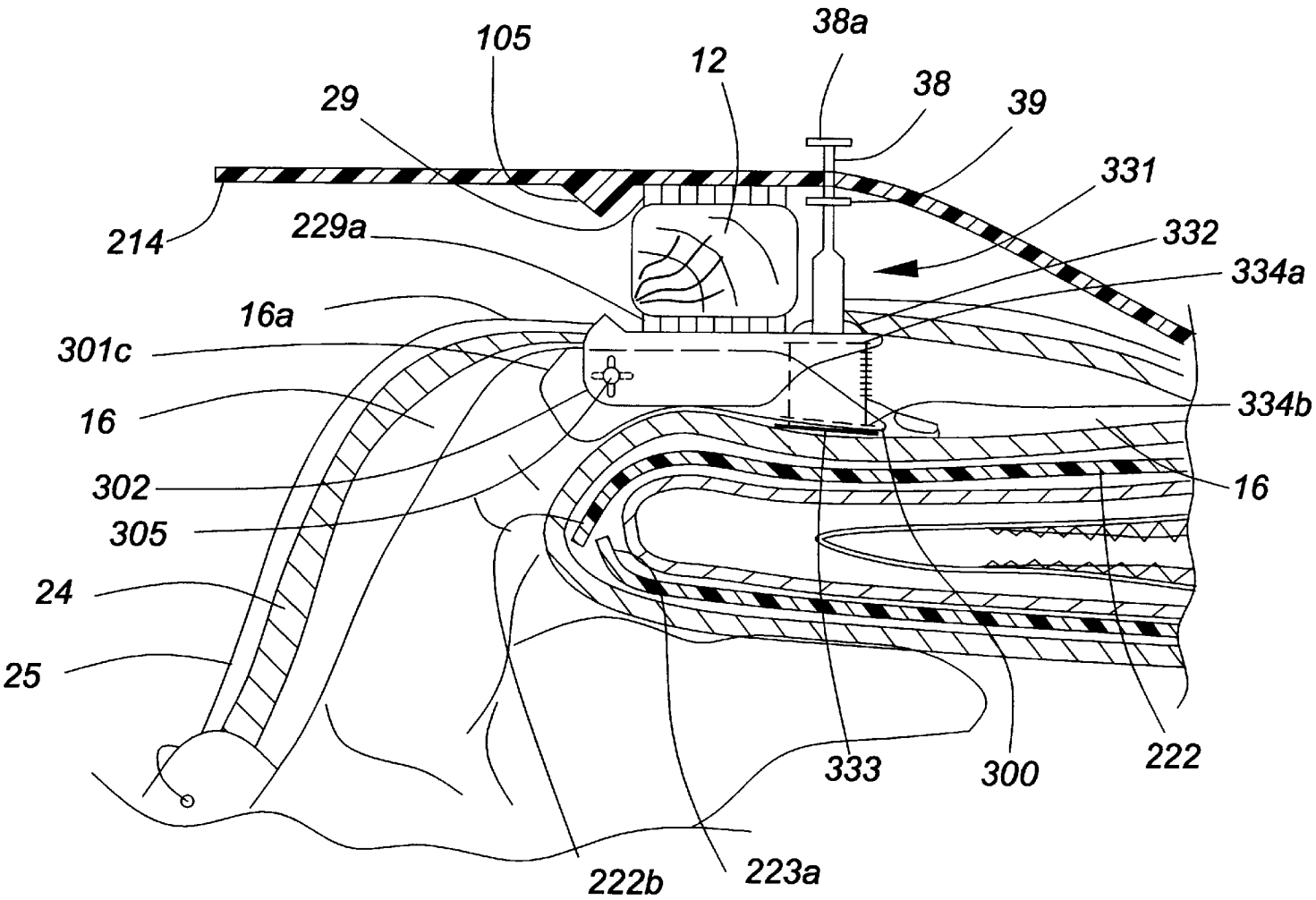
FIG. 26 is view similar to FIG. 15 of another modified glove.

FIG. 26 shows a further embodiment of glove with additional features shown in FIGS. 27 and 28.

In FIG. 26, a modified stabilizer 300 has adjustable stabilizing side plates 302 shown connected each by a single screw 305 to the side flanges 301*c* of the stabilizer unit and also connected and supported by a base part of the control means 331 via washer 334*a* also shown in FIG. 27. As shown in the latter Figure, the control means has a hollow base part 332, threaded from top to bottom, with two threaded washers 334*a* and 334*b*. Washer 334*a* is used to support one end of stabilizing bridging plate part 301*a* shown in FIG. 28. A similar arrangement could be used for the bridging plate parts shown in FIGS. 19 to 35.

FIG. 28 shows the modified stabilizing unit 300 as having elongated apertures 300*a*, which allow the stabilizing unit to be adjusted fore and aft independently of the palm plate 222 and gripping plate 314.

Figure 29:
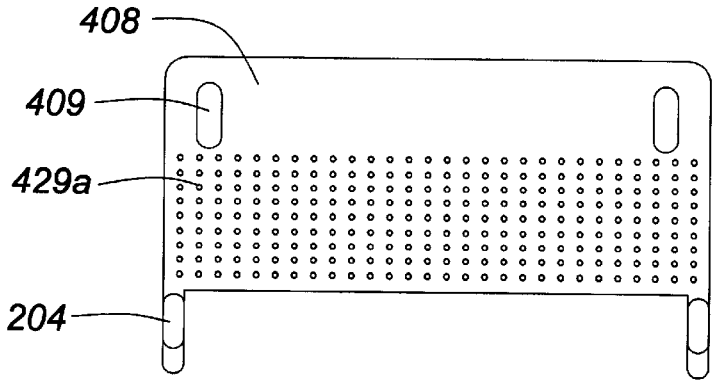
FIG. 29 is a top view of part of another stabilizer.
Figure 30:
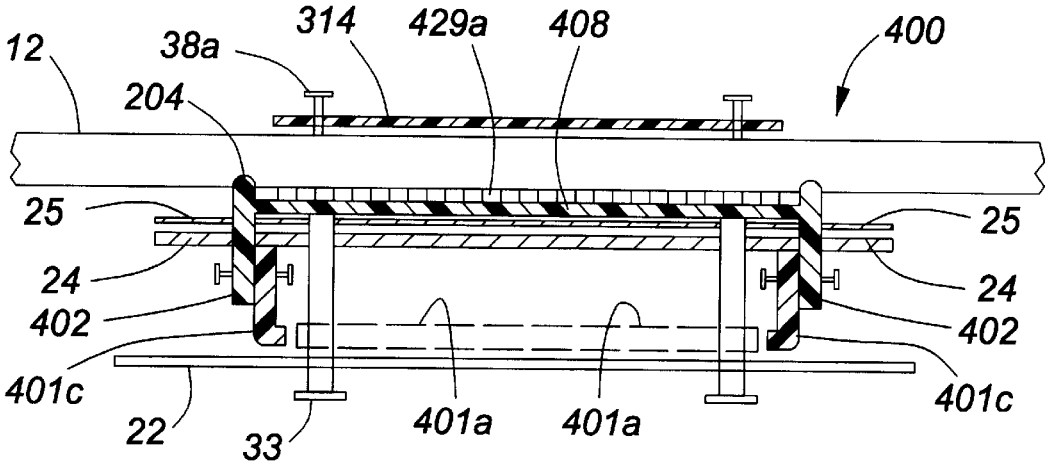
FIG. 30 is a view similar to FIG. 23 of the stabilizer of FIG. 29, with a dotted outline of an optional narrow plate connected to the control means, over which the fingers lie.

FIGS. 29 and 30 show a further modified form of stabilizing unit 400 in which the pressure member is a stabilizing plate 408 which extends across the upper edges of the side plates 402 and may be provided with a rubberized outer surface 429*a* suitable for gripping the stick 12, thus expanding the area for gripping as compared to use of the upper surfaces of the side plates previously described. The side plates 402 are connected to the pressure member 408 and the bearing load distributed along the palm plate by flanges 401*c* which may or may not be united by bridging part 401*a*. As shown in FIG. 29, the stabilizing plate 408 has apertures 409 for guiding the stabilizer in the absence of bridging part 401*a*.

The FIG. 30 embodiment may be modified by eliminating the bridging part, i.e. part 401*a* in FIG. 30, as indicated in broken lines. In this case the side plates 401*c* are connected only by the plate 408. Alternatively, the side plates may be connected by a narrow plate passing underneath the knuckle area of the fingers.

Figure 31:
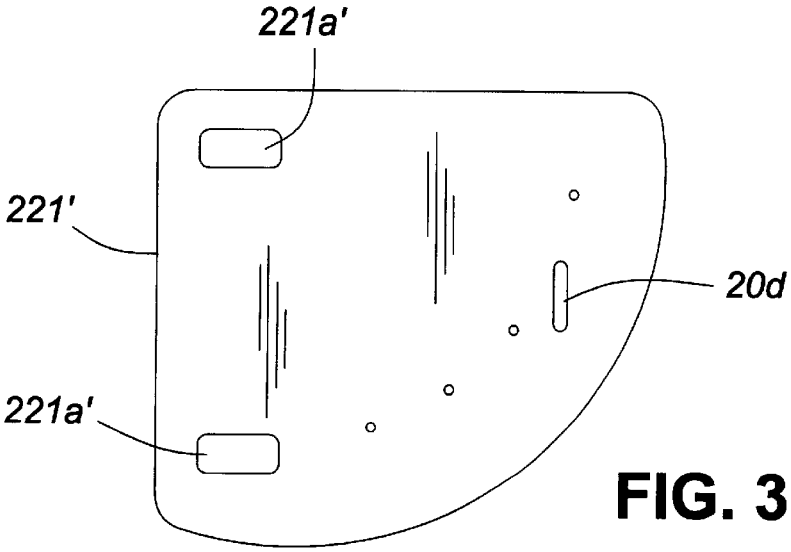
FIG. 31 is a view of a modified palm plate.

FIG. 31 shows modified palm plate 222', with aperture 20*d* located in the area of the inner lacing 20 of the glove and running perpendicular to aperture 220*c* of gripping plate 214, as shown in FIG. 18, to alter the angle of the gripping plate corresponding to adjustments made in the position of the control means 231 within the apertures 222'*a* of the palm plate 222'.

FIGS. 32 to 35 show means whereby the palm plate and the stabilizer are adjustable relative to the control means, especially to take account of different finger lengths.

Figure 32:
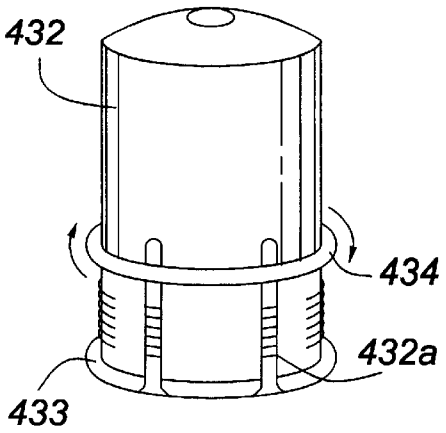
FIG. 32 is a perspective view of another form of the hollow base of control means.
Figure 33:
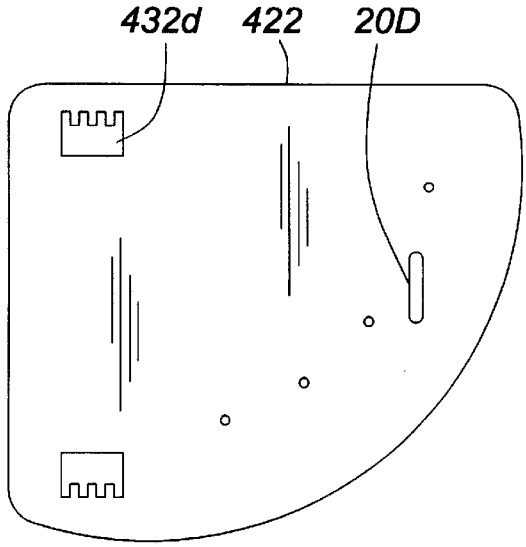
FIG. 33 is a plan view of another form of palm plate.
Figure 34:
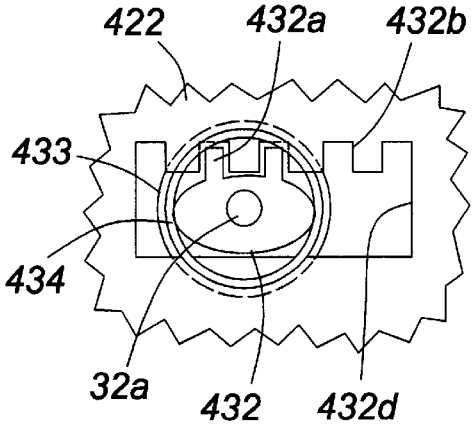
FIG. 34 shows how the FIG. 32 hollow base part connected to the FIG. 33 palm plate.

FIG. 32 shows a control means with a hollow base part 432 having two ridges 432*a,* and scored on its outer surface to accept threaded washer 434. These ridges interact with slots 432*b* of the notched apertures 432*d* located at the outer edge of the palm plate 422 shown in FIGS. 33 and 34 to allow adjustability of the control means relative to the palm plate. The manner in which these ridges 432*a* engage in the slots 432*b* is shown in detail in FIG. 34.

Figure 35:
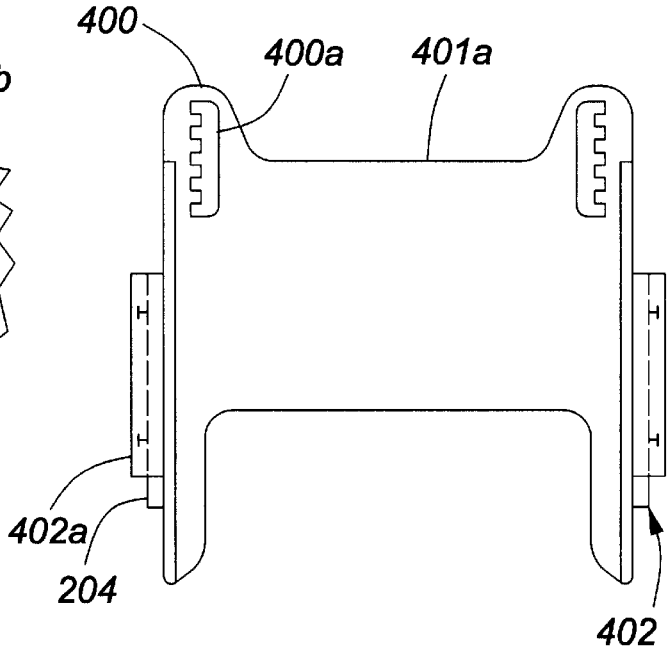
FIG. 35 shows a further modified stabilizer.

FIG. 35 shows that the stabilizing unit 400 may have notched apertures 400*a* at the front of the unit and which may be secured to palm plate 422 by washer 434, or may sit above this washer, being locked into position by virtue of its notched aperture. The notched apertures 400*a* match the grooves on the outer surface of the hollow base part 432 of the control means allowing for forward and backward adjustment so as to accommodate the varying finger length of the user.

Figure 36:
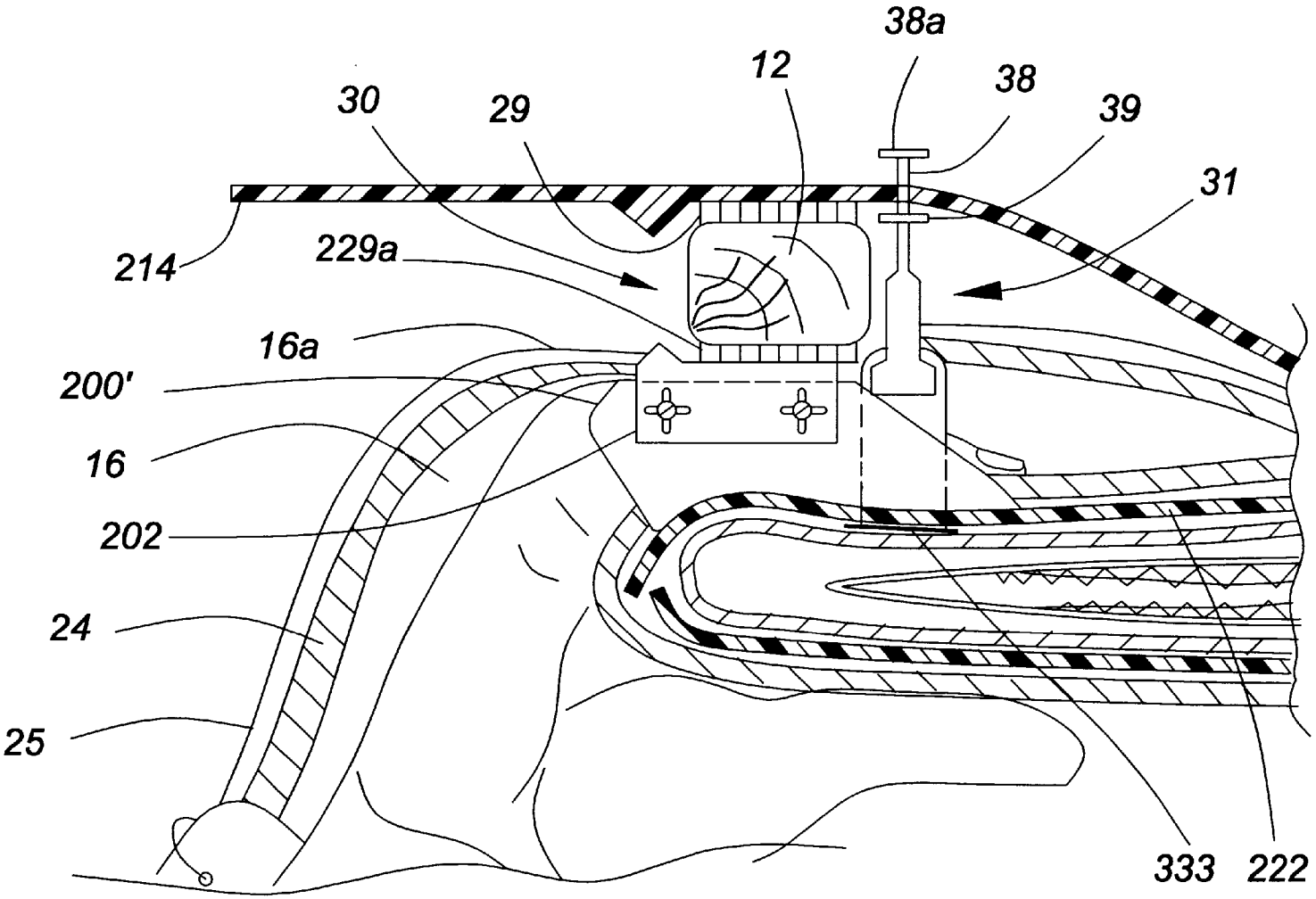
FIG. 36 shows a view similar to FIG. 15 of a further modified glove.

FIG. 36 shows a glove generally similar to that of FIG. 16 but in which the stabilizer 200' is formed as a unit with the palm plate 222. As before, bending of the fingers causes tilting of the stabilizer 200' so that the stabilizer surfaces move outwards, relative to the control means 31 which pulls on the gripping plate 214, this action assisting the holding action provided by the knuckles acting against an outer portion of the glove.

Figure 37:
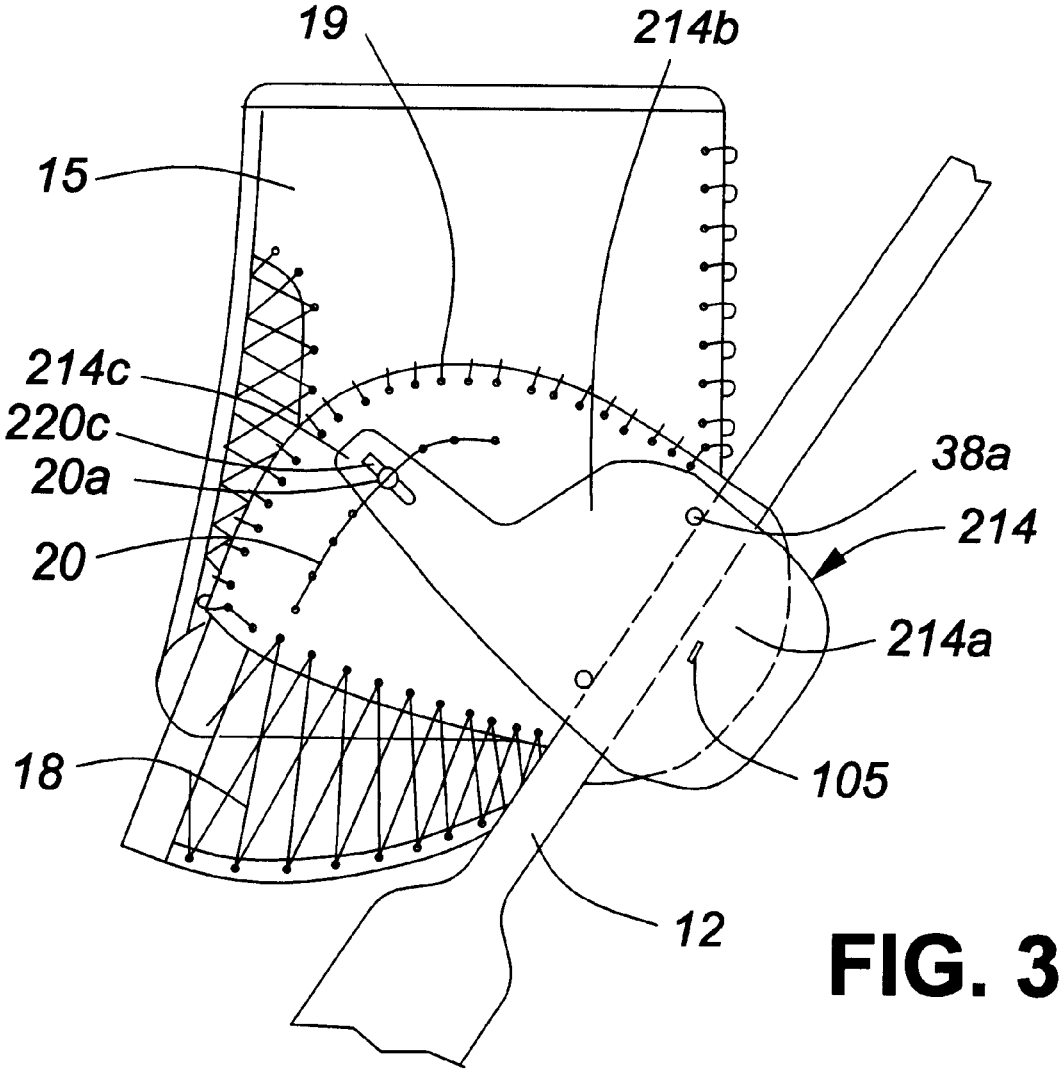
FIG. 37 is a view of the glove of FIG. 16 showing the gripping plate of FIG. 16.
Figure 38:
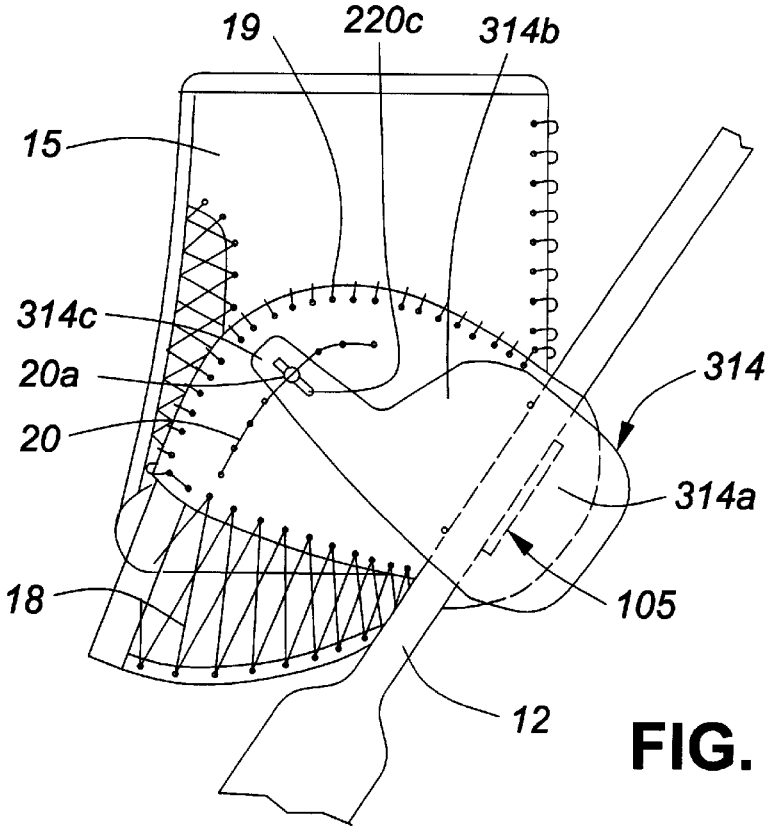
FIGS. 38 and 39 are similar views of gloves having modified gripping plates.
Figure 39:
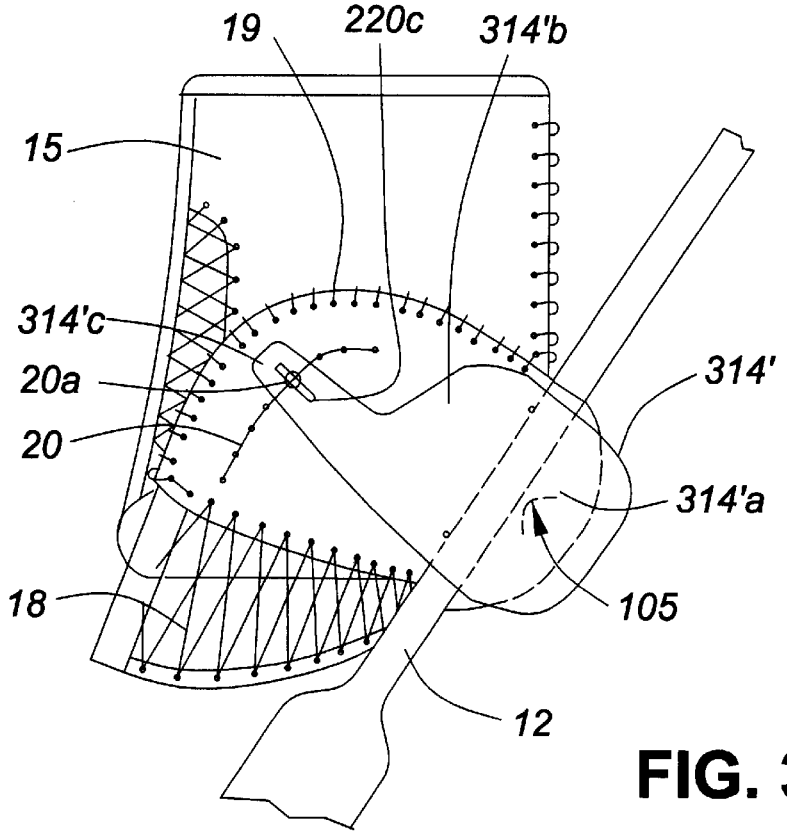

FIG. 37 illustrates the position of the raised area 105 on the underside of a gripping plate 214. FIGS. 38 and 39 are similar drawings showing modified shapes for these raised areas in gripping plates 314 and 314'.

I claim:

1. A glove for holding a handle portion of an implement, including a sports implement, the glove having finger pocket means with an outer side for overlying the user's knuckles;

the glove further comprising a handle retainer which overlies a portion of said outer side portion of the finger pocket means, said retainer having spaced connections firstly to an outer end portion of the glove beyond tips of fingers when in the glove, and secondly to control means at an outer finger area for controlling movement away from the outer side portion, said retainer having a stiffness such that, with the control means acting on the retainer, a handle portion of an implement can be held firmly between said outer side portion and the retainer while all the user's fingers remain in the finger pocket means, the control means being such that inwards flexing of the fingers in said finger pocket means causes the retainer to be pulled towards said outer side portion to more firmly hold said handle portion.

2. A glove according to claim 1, wherein the retainer is suitable for holding the handle part of a racquet or the handle portion of a hockey stick.

3. A glove for use by a hockey goalkeeper, having finger pocket means and a thumb pocket, the finger pocket means forming part of the glove body and having an outer side for overlying the goalkeeper's knuckles;

the glove further comprising a hockey stick retainer which overlies a portion of said outer side of the finger pocket means, said stick retainer being connected to control means for controlling movement away from the outer side portion, said retainer having a stiffness such that, with the control means acting on the retainer, a hockey stick can be held firmly between said outer side portion and the retainer while all the goalkeeper's fingers remain in the finger pocket means.

4. A glove according to claim 1, wherein said control means include spring means acting to pull the retainer towards said outer side portion.

5. A glove according to claim 1, wherein said control means include stop means which limit the movement of the retainer relative to a stiff plate located at the inner or palm side of the finger pocket means, and wherein said outer side of the finger pocket means is flexible relative to said plate and allows a user's fingers to be bent so that the fingertips press against the stiff plate while outwards movement of the finger knuckles causes said outer side portion to firmly grasp the handle or stick between itself and the retainer.

6. A glove according to claim 5, wherein said control means includes a hollow chamber attached to said stiff plate in the area of a user's fingers, and a stop member having an inner end portion mounted for limited movement in said chamber and having an outer end restricting movement of said retainer away from said stiff plate.

7. A glove according to claim 5, wherein said stiff plate is a palm plate forming an inner surface of the body portion of the glove, and wherein said control means are located in an area between the second knuckles and finger tips of fingers placed within said finger pocket means, and wherein the connection between the retainer and the outer end portion of the glove is made through the body of the glove to the palm plate outwardly beyond the tips of fingers when in the finger pocket means.

8. A glove according to claim 7, wherein said retainer has two spaced connections to the glove body both located outwardly beyond tips of fingers when in the finger pocket means.

9. A glove according to claim 6, wherein said hollow chamber is positioned and shaped to fit between the user's fingers when the fingers are in position in the finger pocket means.

10. A glove according to claim 6, wherein said hollow chamber is one of a pair of chambers situated on outer sides of the four fingers of a user when in position in the finger pocket means.

11. A glove according to claim 1, wherein the retainer has a rubberized high friction surface facing said outer side portion of the finger pocket means.

12. A glove according to claim 1, wherein said control means are adjustable forwardly and rearwardly of the glove.

13. A glove according to claim 1, wherein said outer side portion of the finger pocket means includes a rigid member, said rigid member having an outer part which is a pressure member and which projects through the outer side of the finger pocket means, and an inner part of which rigid member is a plate inside the finger pocket means and contactable by the insides of the knuckle areas of a user's fingers, said parts being arranged so that flexing of the user's fingers causes the pressure member to bear against an inner side of said handle portion while the inner part of the rigid member presses against the palm plate.

14. A glove for holding a handle portion of an implement, including a sports implement, the glove having finger pocket means with an outer side for overlying the user's knuckles, the glove further comprising:

a handle retainer which overlies a portion of said outer side of the finger pocket means;

control means connecting said handle retainer to an inner side of said finger pocket means adjacent a user's finger tips and limiting movement of the retainer away from the outer side portion of the finger pocket means;

a rigid member having a part which is a pressure member and which projects through the outer side of the finger pocket means and part of which is a plate movable by the knuckle areas of a user's fingers, said parts of the rigid member being arranged so that the pressure part can be caused to move outwardly against an inner side of said handle by flexing of said fingers while the retainer is pulled inwardly against the outer side of the handle by the user's finger tips pulling on said control means.

15. A glove according to claim 14, wherein said control means includes stop means which limit movement of the handle retainer relative to a stiff plate located at the inner or palm side of the finger pocket means and movable by the user's finger tips.

16. A glove according to claim 14, wherein said rigid member includes side plates having outer edges providing two of said pressure members which project through the outer side of said finger pocket means, said side plates being connected by said stiff plate.

17. A glove according to claim 16, wherein said stiff plate is positioned to underlie the knuckle areas of the user's fingers.

18. A glove according to claim 16, wherein the outer edges of said side plates are adjustable relative to the stiff plate.

19. A glove according to claim 16, wherein said stiff plate is positioned to overly the user's knuckles.

* * * * *